US010787844B2

(12) United States Patent
Keller et al.

(10) Patent No.: US 10,787,844 B2
(45) Date of Patent: Sep. 29, 2020

(54) DOOR GUARD AND METHOD OF USING THE SAME

(71) Applicant: School Gate Guardian, Inc., State College, PA (US)

(72) Inventors: Christopher Keller, State College, PA (US); Terence Kirby, State College, PA (US); Troy Shearer, York, PA (US)

(73) Assignee: School Gate Guardian, Inc., State College, PA (US)

( * ) Notice: Subject to any disclaimer, the term of this patent is extended or adjusted under 35 U.S.C. 154(b) by 428 days.

(21) Appl. No.: 15/810,603

(22) Filed: Nov. 13, 2017

(65) Prior Publication Data

US 2019/0145139 A1 May 16, 2019

(51) Int. Cl.
*E05C 19/00* (2006.01)
*E05B 73/00* (2006.01)

(52) U.S. Cl.
CPC ..... *E05C 19/003* (2013.01); *E05B 73/0005* (2013.01)

(58) Field of Classification Search
CPC .. E05C 19/003; E05B 73/0005; Y10S 292/15; Y10S 292/53; Y10S 292/65
See application file for complete search history.

(56) References Cited

U.S. PATENT DOCUMENTS 1,707,694 A * 4/1929 Torrence ..... E05C 19/003 70/134
2,673,112 A * 3/1954 Andrews ..... E05C 19/182 292/296
3,321,229 A * 5/1967 Eckel ..... E05C 19/003 292/108
3,563,593 A * 2/1971 Leier ..... E05C 19/182 292/296
4,067,598 A * 1/1978 Mansour ..... E05C 19/003 292/259 R
4,105,232 A * 8/1978 Miels ..... E05C 19/184 292/288
5,474,343 A * 12/1995 Ledbetter ..... E05C 19/003 292/259 R
5,590,928 A * 1/1997 Voiculescu ..... E05C 17/446 292/338

(Continued)

FOREIGN PATENT DOCUMENTS

DE 319543 C * 3/1920 ..... E05C 19/003

*Primary Examiner* — Alyson M Merlino

(74) *Attorney, Agent, or Firm* — Buchanan Ingersoll & Rooney PC

(57) ABSTRACT

Methods and apparatuses can be configured to facilitate the guarding of doors to replace the need for a lock or to supplement a lock to help bar access to a room via a door. Embodiments of the apparatus can be configured as a door guard. The door guard can be mountable adjacent a door and be configured for attachment to a door via a mounting device attached to a rear of a door so that a door guard can be positioned quickly in the event of an unanticipated emergency situation. The door guard may block opening of a door outward out of a room and into an adjoining hallway of a building by preventing extending to opposite sides of a door frame or walls defining the door opening to prevent an attacker from pulling the door open.

17 Claims, 8 Drawing Sheets

(56) References Cited

U.S. PATENT DOCUMENTS

| | | | | |
|---|---|---|---|---|
| 5,669,641 | A * | 9/1997 | Jeansonne | E05C 19/003 292/259 R |
| 6,347,817 | B1 * | 2/2002 | Chou | B60P 7/15 248/230.6 |
| 6,557,912 | B1 * | 5/2003 | Truong | E05C 17/50 292/338 |
| 7,637,130 | B2 | 12/2009 | Carr | |
| 9,303,434 | B2 | 4/2016 | Tarquinio | |
| 9,435,147 | B1 | 9/2016 | Giandomenico, Jr. et al. | |
| 2008/0263958 | A1 | 10/2008 | Edson | |
| 2016/0281416 | A1 | 9/2016 | Spransy | |
| 2017/0008188 | A1 | 1/2017 | Staffen | |

* cited by examiner

DOOR GUARD AND METHOD OF USING THE SAME

FIELD OF THE INVENTION

The present innovation relates to door guards configured to prevent a door from being opened and methods of making and using such door guards.

BACKGROUND OF THE INVENTION

Personal safety can often be improved by use of locks or other devices configured to prevent a door or window from being opened. Some internal doors may not always have locks or may only have weak locks. In some settings, it can be necessary to ensure that a door can be reinforced to ensure that an attacker is unable to easily pass through a door. A door without a lock or a door with a lock that is easily broken by kicking the door or shooting the door handle with a firearm may not provide sufficient protection for some circumstances. Examples of different mechanisms that can be utilized for locking a door can be appreciated from U.S. Pat. App. Pub. Nos. 2017/008188, 2016/0281416, and 2008/0263958 and U.S. Pat. Nos. 9,435,147, 9,303,434 and 7,637,130

SUMMARY OF THE INVENTION

I determined that a new method and apparatus of guarding a door is needed. Embodiments of such methods and apparatuses can be configured to help prevent a door from being opened even after a lock of the door is broken by an attacker. Embodiments of the door guard apparatus can also be configured to utilize a lock mechanism to limit how the apparatus may be used within a room to try and prevent improper use of the apparatus.

In some embodiments, a door guard apparatus can include an elongated member having a first end and a second end opposite the first end and a carrier having a front and a rear. The front of the carrier can have a vertically extending arm. The elongated member can pass through a middle portion of the carrier between the front and the rear of the carrier. The elongated member can be connected to the carrier so that the first end of the elongated member extends away from a first side of the carrier and the second end of the elongated member extends away from a second side of the carrier that is opposite the first side of the carrier. A first locking mechanism can be connected to the carrier. The first locking mechanism can be moveable between a locked position and an unlocked position. A biasing mechanism can be connected between the carrier and the locking mechanism to bias the locking mechanism to the locked position.

Embodiments of the door guard apparatus can also include a mounting body that is attachable to a door. The mounting body can include an inner door surface plate and an outer plate connected to a first side of the inner door surface plate and a second side of the inner door surface plate such that a slot is defined between the inner door surface plate and the outer plate. The slot can be configured to receive the vertically extending arm. In some embodiments, the outer plate can have a projection that extends outwardly away from the slot and away from the inner door surface plate and the locking mechanism can be configured to contact the projection of the outer plate and move from the locked position to the unlocked position and stay in the unlocked position as it moves along the projection until it reaches a bottom edge of the projection while the vertically extending arm is moved into the slot. The biasing mechanism can be configured to move the locking mechanism from the unlocked position to the locked position so that the locking mechanism contacts the bottom edge of the projection of the outer plate and latches on to the bottom edge to lock the carrier onto the mounting body when a moveable finger of the locking mechanism is at the bottom edge of the projection and the vertically extending arm is within the slot. The vertically extending arm can be at a bottommost position in the slot when the moveable finger contacts the bottom edge of the projection to latch on to the bottom edge to lock the carrier onto the mounting body.

The biasing mechanism can include at least one spring. For example, the biasing mechanism can include at least one torsion spring, at least one elastomeric spring, or at least one spring member.

In some embodiments, the elongated member can be adjustably connected to the carrier within a central opening of the carrier between the front and the rear of the carrier such that an extent to which the elongated member extends away from the first side of the carrier and an extent to which the elongated member extends away from the second side of the carrier are adjustable at the same time. A first end cap can be connected to the first end of the elongated member for contacting a wall or door frame adjacent a first side of a door and a second end cap can be connected to the second end of the elongated member for contacting a wall or door frame adjacent a second side of the door.

Embodiments of the door guard apparatus can also include a hanger that is mountable to a wall adjacent a door. The hanger can have a first finger and a second finger spaced apart from the first finger to define a gap so that the elongated member is passable through the gap. The hanger can be configured to contact the first side of the carrier or the second side of the carrier to hold the carrier such that the elongated member passes through the gap while the carrier is held by the first and second fingers. The hanger can also include a wall mounting body attached to the first and second fingers such that the first and second fingers extend away from the wall mounting body.

Embodiments of a method of using a door guard apparatus to brace a door of a room can include providing an embodiment of our door guard apparatus, mounting a mounting body of the door guard apparatus to a door, and moving a vertically extending arm attached to a carrier into the slot such that the locking mechanism engages the mounting body and moves from a locked position to an unlocked position as the vertically extending arm is passed into the slot and moves from the unlocked position to the locked position when the vertically extending arm is at a bottom position in the slot. The first end of the elongated member can extend past a first side of the door and a second end of the elongated member can extend past a second side of the door when the vertically extending arm is within the slot to prevent the door from being pulled open by a person outside the room.

In some embodiments of the method, the moving of the vertically extending arm into the slot such that the locking mechanism engages the mounting body and moves from a locked position to an unlocked position as the vertically extending arm is passed into the slot and moves from the unlocked position to the locked position when the vertically extending arm is at a bottom position in the slot can include: a moveable finger of the locking mechanism contacting a projection extending outwardly and downwardly away from the slot and the outer plate such that the finger is moved away from the slot and guided along the projection until the vertically extending arm is at the bottom position in the slot, the moveable finger being at a bottom edge of the projection when the vertically extending arm is at the bottom position in the slot, and the biasing mechanism acting on the moveable finger to cause the moveable finger to engage the bottom edge of the projection to latch on to the bottom edge of the projection to lock the carrier onto the mounting body while the vertically extending arm is at the bottom position in the slot.

Embodiments of the method can include other steps or elements. For example, the method can include moving the moveable finger away from the bottom edge to unlatch the finger from the bottom edge and move the locking mechanism to the unlocked position, and while the moveable finger is moved away from the bottom edge of the projection and the locking mechanism is in the unlocked position, sliding the vertically extending arm out of the slot. The method can also include adjusting a position of the elongated member within a central opening of the carrier between the front and the rear of the carrier such that an extent to which the elongated member extends away from the first side of the carrier and an extent to which the elongated member extends away from the second side of the carrier are adjusted at the same time.

The method can further include hanging the carrier on a wall via a hanger mounted to the wall. For example, the carrier can be hung via the hanger such that first and second spaced apart fingers of the hanger contact the first side of the carrier or the second side of the carrier to hold the carrier and the elongated member passes through a gap between the first and second fingers while the carrier is held by the first and second fingers.

Embodiments can also be configured as door guard. The door guard can include an elongated member having a first end and a second end opposite the first end, a carrier having a front and a rear. The front of the carrier can have a vertically extending arm and the elongated member can pass through a middle portion of the carrier between the front and the rear of the carrier. The elongated member can be connected to the carrier so that the first end of the elongated member extends away from a first side of the carrier and the second end of the elongated member extends away from a second side of the carrier that is opposite the first side of the carrier. A locking mechanism can be connected to the carrier. The locking mechanism can have a moveable finger that is moveable between a locked position and an unlocked position. At least one spring member can be connected between the carrier and the locking mechanism to bias the moveable finger of the locking mechanism to the locked position. A mounting body that is attachable to a door can be included in the door guard. The mounting body can include an inner door surface plate and an outer plate connected to a first side of the inner door surface plate and a second side of the inner door surface plate such that a slot is defined between the inner door surface plate and the outer plate. The slot can be configured to receive the vertically extending arm.

The outer plate can have a projection that extends outwardly away from the slot and away from the inner door surface plate in some embodiments of the door guard. The moveable finger can be configured to contact the projection and move from the locked position to the unlocked position and stay in the unlocked position as the moveable finger moves along the projection until it reaches a bottom edge of the projection while the vertically extending arm is moved into the slot. The moveable finger can be biased to contact the bottom edge and latch on to the bottom edge of the projection to lock the carrier onto the mounting body via the at least one spring member when the moveable finger is at the bottom edge of the projection. In some embodiments, the vertically extending arm can be at a bottommost position in the slot when the moveable finger contacts the bottom edge of the projection to latch on to the bottom edge to lock the carrier onto the mounting body.

Other details, objects, and advantages of a door guard and methods of making and using the same will become apparent as the following description of certain exemplary embodiments thereof proceeds.

BRIEF DESCRIPTION OF THE DRAWINGS

Exemplary embodiments of a door guard apparatus and methods of making and using the same are shown in the drawings included herewith. It should be understood that like reference numbers used in the drawings may identify like components.

DETAILED DESCRIPTION OF EXEMPLARY EMBODIMENTS

Figure 1:
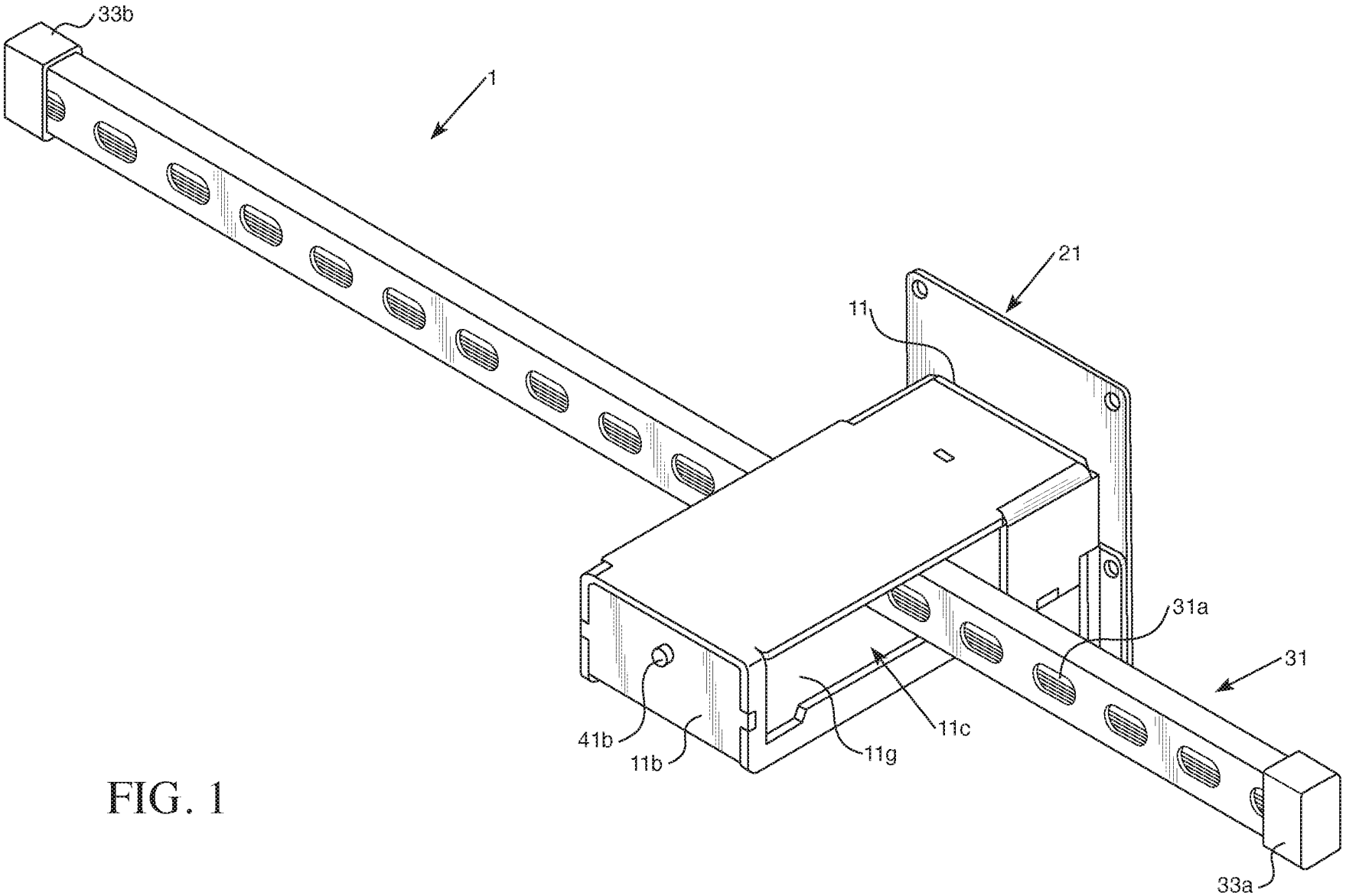
FIG. 1 is a perspective view of a first exemplary embodiment of a door guard apparatus.
Figure 2:
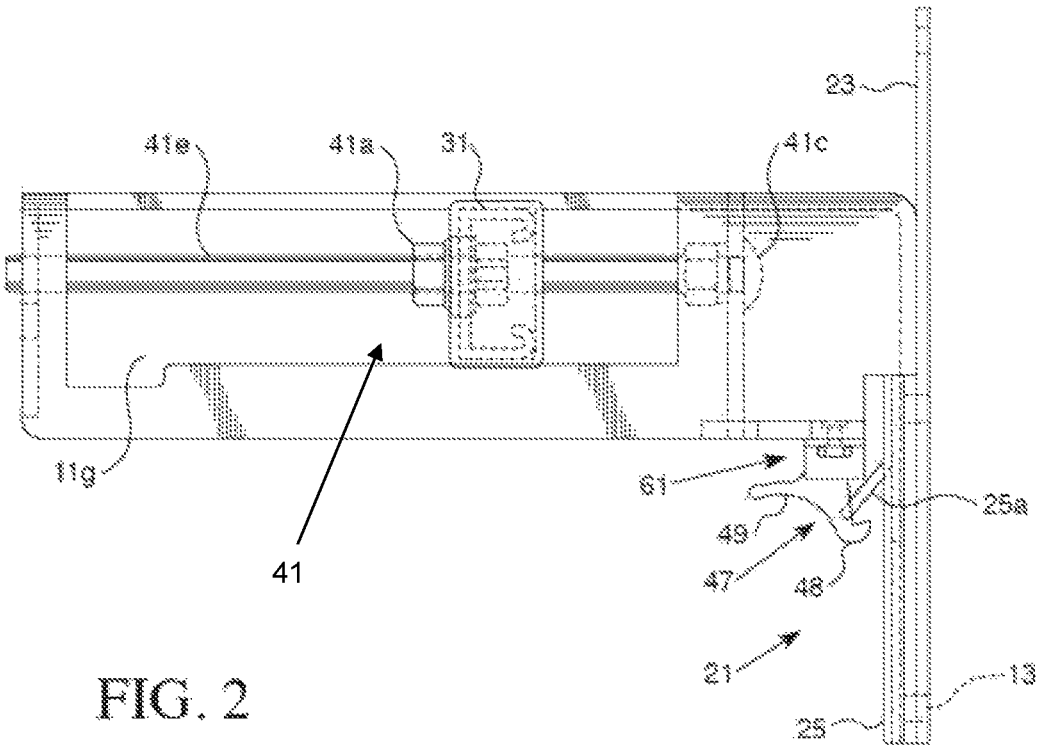
FIG. 2 is a side view of the first exemplary embodiment of the door guard apparatus.
Figure 3:
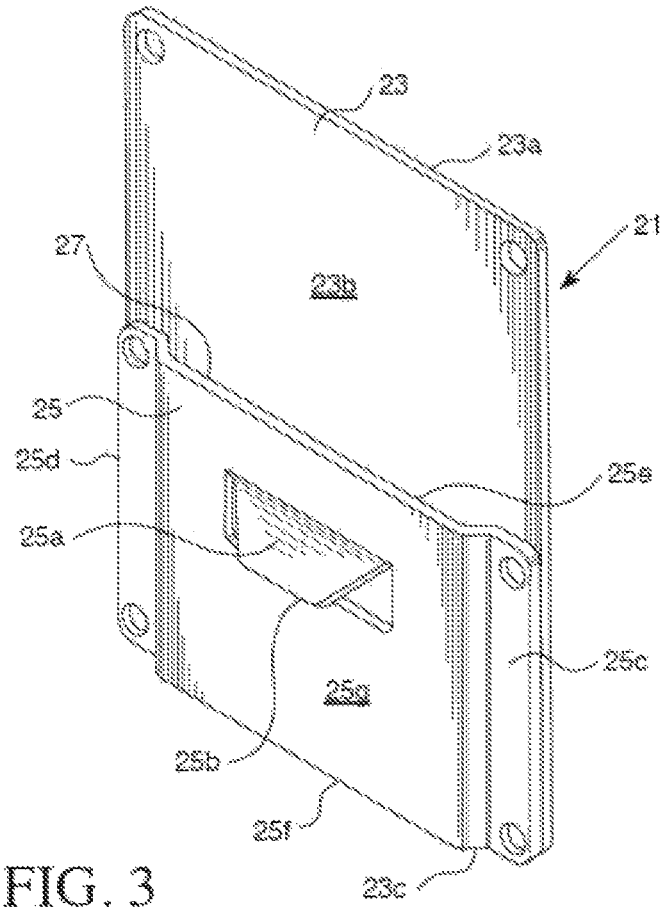
FIG. 3 is a perspective view of a mounting body component of the first exemplary embodiment of the door guard apparatus.
Figure 4:
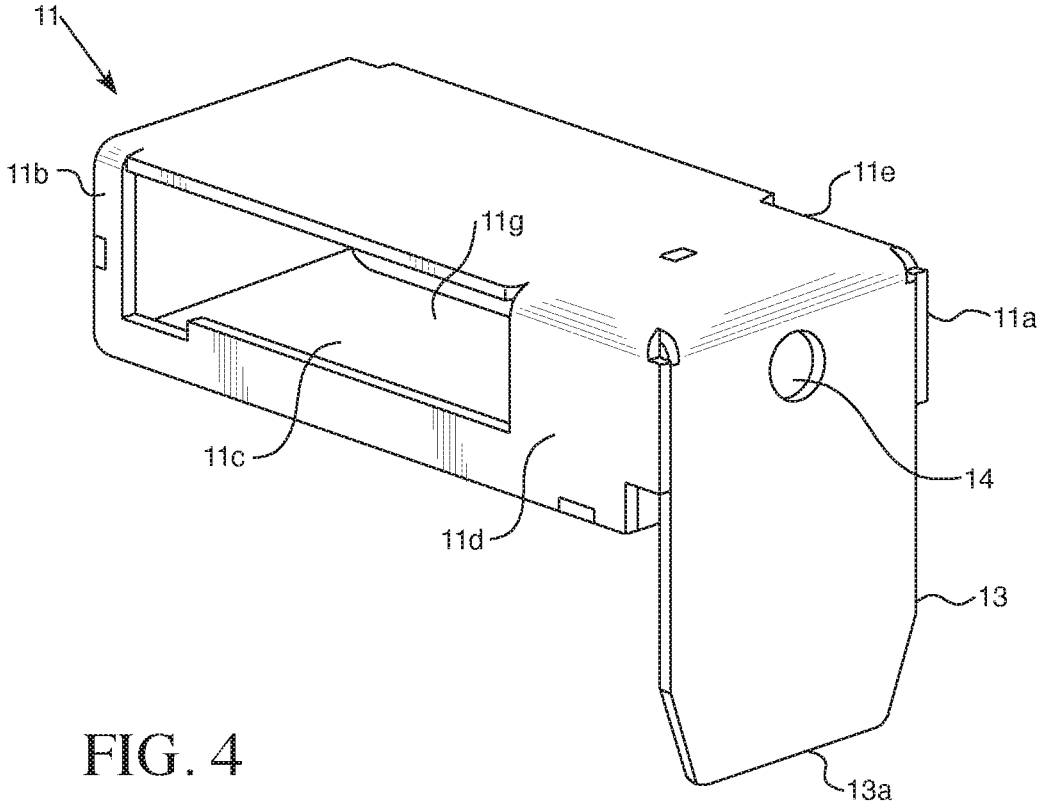
FIG. 4 is a perspective view of a carrier component of the first exemplary embodiment of the door guard apparatus.
Figure 5:
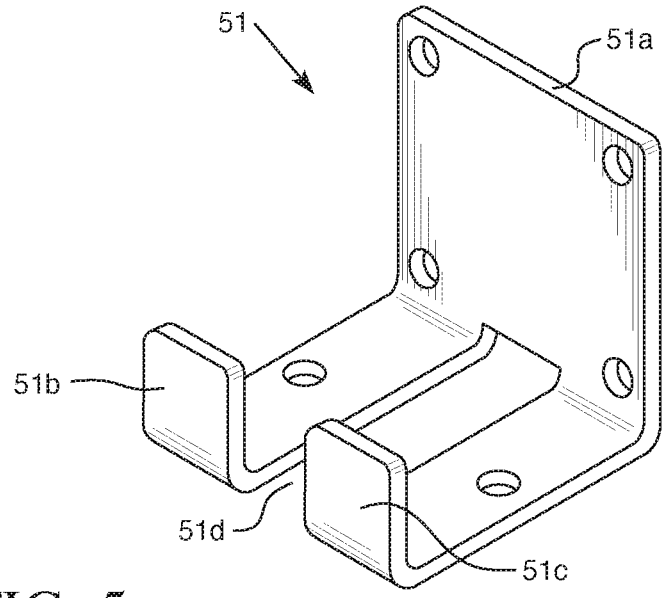
FIG. 5 is a perspective view of an exemplary hanger component that can be included with the first exemplary embodiment of the door guard apparatus.
Figure 6:
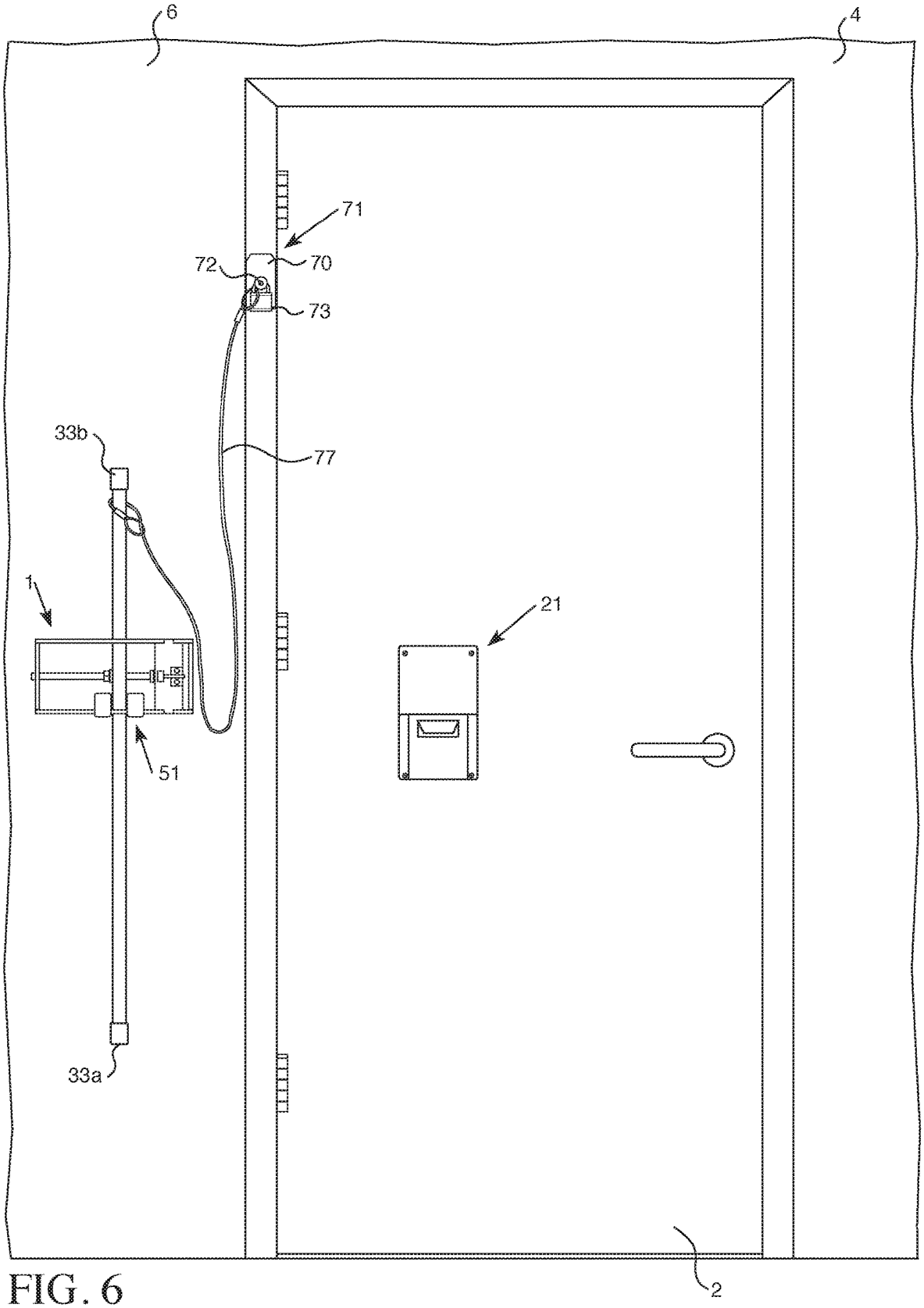
FIG. 6 is a schematic view of the first exemplary embodiment of the door guard apparatus positioned adjacent a door.
Figure 7:
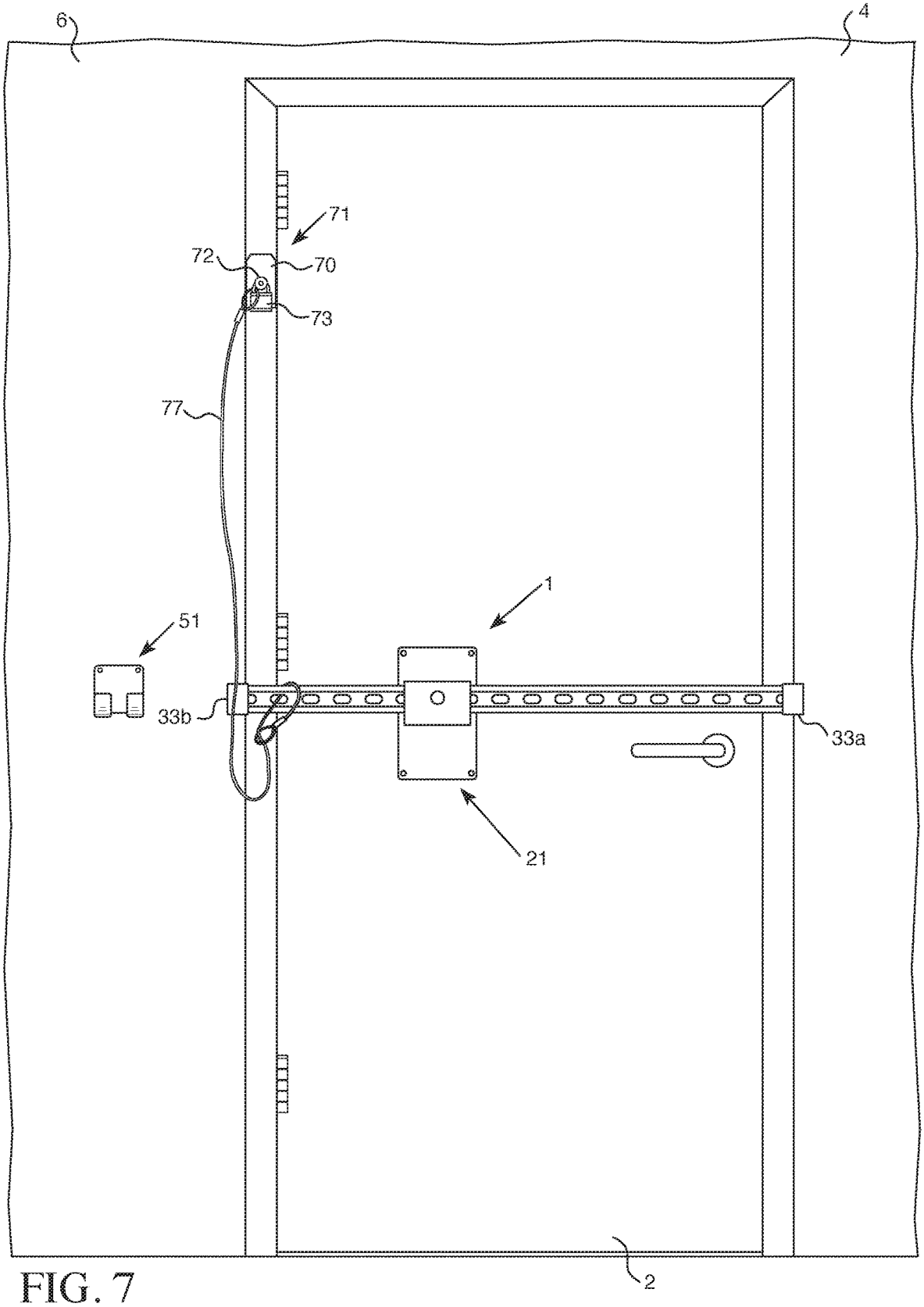
FIG. 7 is a view similar to FIG. 6 with the door guard apparatus positioned to prevent the door from being opened.
Figure 8:
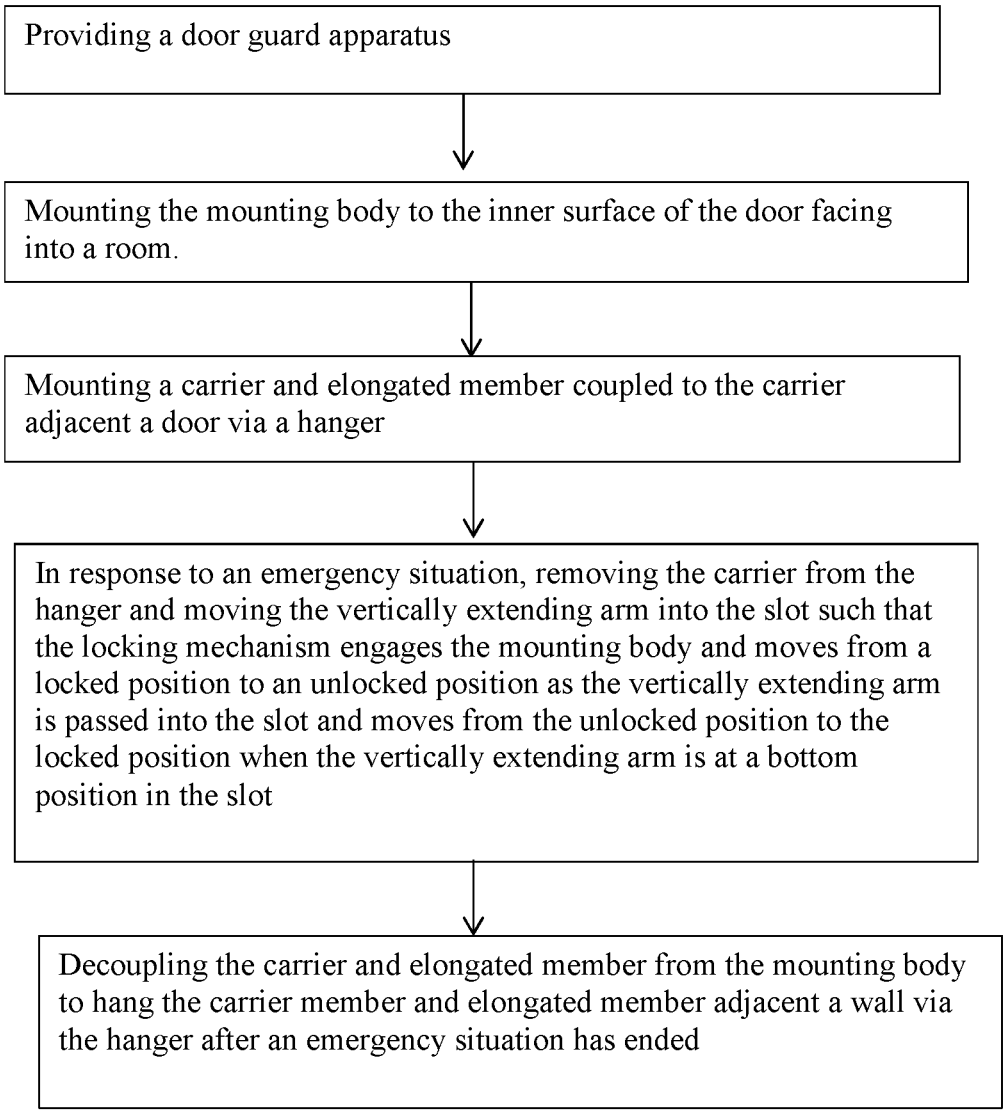
FIG. 8 is a flow chart of an exemplary method of using a door guard apparatus to brace a door of a room.

Referring to FIGS. 1-10, an embodiment of a door guard apparatus 1 can be configured as a door guard or a door guard assembly. The door guard apparatus 1 can include a carrier 11 that is releasably attachable to a mounting body 21. The carrier 11 can be configured to removeably connect to an elongated member 31 that can be configured to extend along a width of a door to contact opposite sides of a door frame and/or walls 4, 6 on opposite sides of the door 2 to prevent the door 2 from being pulled open by a person outside of the room. The walls 4, 6 can define a door opening or help define a door frame to which the door 2 is connected. The door may be hingedly connected to the door frame so that a user must pull the door open from a hallway to gain access to a room in a building. After the door is pulled open such that the room facing surface of the door is moved into the hallway, a user may be able to pass through the open doorway and into the room. When the door is closed, the door facing surface may face towards the room and be in the room and out of the hallway.

The carrier 11 can include a front 11*a*, a rear 11*b* opposite the front, a middle portion 11*c* that defines a cavity or other type of opening therein. The carrier can also include a first side 11*d* and a second side 11*e* that is opposite the first side 11*d*. The first and second sides 11*d* and 11*e* can extend from the front 11*a* to the rear 11*b* of the carrier. The carrier 11 can be composed of metal such as steel, or another type of suitable material (e.g. a suitable ceramic material, polymeric material, composite material, other type of metal, etc.).

The carrier 11 can have a vertically extending arm 13 that is attached to the front 11*a* of the carrier 11 or is defined on the front 11*a* of the carrier 11. In some embodiments, the vertically extending arm 13 can be a separate element that is welded or otherwise attached to the front 11*a* of the carrier 11. In other embodiments, the vertically extending arm 13 can be a portion of the front 11*a* of the carrier that is formed when the carrier 11 is formed, molded, and/or fabricated. The vertically extending arm may extend linearly from the front 11*a* of the carrier to a position below the carrier 11. The vertically extending arm 13 can have a tapered bottom edge 13*a* positioned below a body of the carrier 11 that may define at least a portion (or an entirety) of the middle portion 11*c* that defines a cavity 11*g* in which the elongated member 31 is positioned.

The front 11*a* and/or the vertically extending arm 13 can have a hole 14 defined therein for facilitating attachment of an adjustable connection mechanism 41 to the carrier 11 for facilitating connection between the carrier 11 and the elongated member 31. For example, the hole 14 can be configured to permit a threaded rod 41*e* (e.g. a bolt, a bar, a rail, etc. that has a threaded exterior surface) or other type of element of a connection mechanism 41 to be passed into the carrier to facilitate a connection between the carrier 11 and the elongated member 31. The rear 11*b* of the carrier 11 can also have a hole through which a distal end 41*b* of such a rod or other type of element of the connection mechanism 41 is positionable. The middle portion 11*c* of the carrier 11 can also have a structure configured to facilitate attachment of an opposite distal end 41*c* of the rod or other type of element of the connection mechanism 41 as can be seen from FIG. 2, for example.

The elongated member 31 can have a plurality of spaced apart holes 31*a* defined therein. The holes of the elongated member can be configured to permit the elongated member 31 to be adjustably attached or removably attached to the carrier 11 so that a length to which the elongated member 31 may extend away from the first and second sides 11*d* and 11*e* of the carrier 11 is adjustable to account for different type of door configurations and provide mounting options for door mounting of the door guard apparatus. For instance, a rod element of the connection mechanism 41 can be removed from the carrier 11 and the elongated member 31 can be positioned to pass through a cavity defined by the middle portion 11*c* of the carrier to a desired position. The rod can then be passed through holes in the carrier and a hole 31*a* in the elongated member 31 to secure the elongated member to the carrier 11. The rod 41*e* can be rotated to affix the rod 41*e* to the carrier 11 so that one or more threads defined on the rod 41*e* can engage threads defined in the carrier 11 adjacent at least one of the holes of the carrier. At least one moveable nut 41*a* can also be attached to the rod 41*e* and be moveable along at least one thread defined on the rod 41*e* along a length of the rod 41*e* for moving into engagement with the elongated member 31 in the cavity 11*g* to lock the position of the elongated member 31, affix the elongated member 31 to the carrier 11, and maintain the elongated member in its selected position in the cavity. If the position of the elongated member 31 needs adjusted after this affixation, the one or more nuts 41*a* may be loosened out of engagement with the elongated member 31, the rod 41*e* can be removed from the carrier 11 to decouple the elongated member 31 from the carrier 11 so that the elongated member's position can be adjusted. Such adjustment can adjust the extent to which the elongated member 31 extends away from the first and second sides 11*d* and 11*e* of the carrier 11 (e.g. moving the elongated member so it extends further away from the first side 11*d* to a longer length away from the first side 11*d* and so it extends a shorter distance away from the second side 11*e* or vice versa). Once the elongated member 31 is in a new user desired position, the rod 41*e* may be reinserted into the carrier 11 and the one or more nuts 41*a* can be repositioned on the rod 41*e* for locking the position of the elongated member 31 to the carrier 11 at its new position.

The elongated member 31 can have a first distal end and a second distal end opposite its first distal end. A first end cap 33*a* can be attached to the first distal end of the elongated member and a second end cap 33*b* can be attached to the second distal end of the elongated member. Each end cap can be composed of rubber or other type of material (e.g. polymeric material, elastomeric material, composite material, etc.) to help the ends of the elongated member engage a wall or door frame and provide increased friction for that engagement. The end caps can also be configured to try and minimize damage that may occur to the door frame and/or walls from such contact by providing a softer or more resilient contacting surface for when the elongated member engages the walls or door frame to prevent the door 2 from being pulled open.

The mounting body 21 can be configured for attachment to an internal surface of the door 2 that is the surface of the door that faces into a room. The door 2 can be configured so that a user must pull the door from an adjoining hallway to open the door 2 and gain access to the room. The inner surface of the door 2 to which the mounting body 21 is attached can be within the room and face into the room when the door is closed and be positioned in the hallway adjoining the room when the door is opened.

The mounting body 21 can include an inner plate 23 that is attached to an outer plate 25 to define a slot 27 between the inner plate 23 and the outer plate 25. The inner plate may have a top 23*a*, a bottom 23*c*, and a middle portion 23*b* that extends linearly from the top 23*a* to the bottom 23*b*. The inner plate 23 can be configured as an inner door surface plate for contacting the inner door surface when the mounting body 21 is mounted onto the door (e.g. fastened to the door, affixed to the door, attached to the door, etc.).

The outer plate 25 can have a first side 25*c* and a second side 25*d* opposite the first side 25*c* of the outer plate 25. The first and second sides 25*c* and 25*d* can extend from a bottom 25*f* of the outer plate 25 to a top 25*e* of the outer plate 25. The middle portion 25*g* of the outer plate between the first and second sides can be configured to be positioned more outwardly from the inner plate 23 than the edges of the first and second sides 25*c* and 25*d* of the outer plate 25. The middle portion 25*g* of the outer plate 25 can also have a projection 25*a* that extends outwardly and downwardly from the middle portion 25*g* of the outer plate 25 towards a distal tapered bottom edge 25*b* of the projection 25*a*. The projection 25*a* may be the outermost portion of the outer plate 25 that is formed when the outer plate is molded or fabricated so that the projection 25*a* is positioned so its top edge is closer to the top 25*e* of the outer plate than its bottom edge 25*b*. The top of the projection 25*a* can be defined on the middle portion 25*g* so that the projection 25*a* extends downwardly and outwardly away from the middle portion 25*g* and slot 27 to the bottom edge 25 so the bottom edge 25 is spaced apart from the middle portion 25*g* and is below the top of the projection 25*a*. Alternatively, the projection 25*a* may be welded to the middle portion 25*g* or otherwise attached to the middle portion 25*g* such that the projection 25*a* is in this position or in this type of configuration.

The outer plate 25 can be coupled to the inner plate 23 at the first and second sides 25*c* and 25*d* of the outer plate via welding or during the molding and/or fabrication of the mounting body 21. The outer plate 25 and inner plate 23 can also have aligned holes configured to facilitate receipt of fasteners for the mounting of the mounting body 21 to the inner surface of the door 2.

The slot 27 defined by the middle portion 25*g* of the outer plate 25 and the middle portion 23*b* of the inner plate 23 can be configured to receive at least a portion or at least a substantial portion of the vertically extending arm 13 (e.g. at least 50% of the length of the vertically extending arm or at least 80% of the length of the vertically extending arm or an entirety of the vertically extending arm that extends below the body of the carrier 11). The slot 27 can be defined so that the vertically extending arm is slideable into the slot 27 along the middle portion 23*b* of the inner plate 23 to a bottommost position within the slot 23 for affixing the carrier 11 and elongated member 31 to the mounting body 21 (and door 2 to which that mounting body 21 can be attached and/or mounted).

A first locking mechanism 47 can be connected to a lower body portion of the carrier 11 adjacent the front 11*a* of the carrier 11 and behind the vertically extending arm 13 such that a moveable finger 48 of the first locking mechanism 47 is positioned behind the vertically extending arm 13 and is closer to the rear 11*b* of the carrier 11 than the vertically extending arm 13 is to the rear 11*b* of the carrier 11.

The first locking mechanism 47 can be attached to the carrier so that a biasing mechanism 61 engages the first locking mechanism 47 to bias the moveable finger 48 into a locked position. The moveable finger can have an outer bottom surface 49 that is configured to permit a user to place a finger or hand on the surface 49 to press upwardly on the surface 49 to rotate or otherwise move the finger 48 away from its locked position to at least one unlocked position. For example, the finger 48 may rotate about a pivotal axis to move between the locked and unlocked positions. The biasing mechanism 61 can be configured so that when a user force is removed from the finger 48, the finger is caused to move back to its locked position via the biasing mechanism 61 acting on the finger 48. In some embodiments, the biasing mechanism 61 can be configured as a spring member or include a spring member. For example, the biasing mechanism 61 can include a torsion spring or be a torsion spring that has one end that engages the body of the carrier 11 and another end that engages the finger 48 to bias the finger 48 toward the locked position.

The first locking mechanism 47 can be configured to work in conjunction with the vertically extending arm 13 for facilitating an interlock with the mounting body 21 so that the carrier 11 and elongated member 31 are attachable to a door's inner surface to brace the door 2 to prevent the door from being opened by a person outside of the room pulling the door via a door handle. For example, when a user slides the vertically extending arm 13 into the slot 27, the finger 48 of the first locking mechanism 47 can be positioned to contact the projection 25*a* and slide along an upper surface of the projection to the bottom edge 25*b* of the projection 25*a* extending downwardly away from the outer plate member 25. As the vertically extending arm 13 is slid downwardly into the slot 27, the finger 48 may be moved to an unlocked position via its contact with the projection 25*a* and can slide downwardly along the projection 25*a* as the vertically arm 13 is slid downwardly into the slot 27 toward the vertically extending arm's bottommost position within the slot 27. When the vertically extending arm is at its bottommost position in the slot, the moveable finger 48 can be at the bottom edge 25*b* of the projection 25*a* such that the finger 48 is caused to move to its locked position via the biasing mechanism 61 to contact the bottom edge 25*b* of the projection to engage the projection 25*a* and interlock with the bottom edge 25*b* of the projection 25*a*. The interlock between the finger 48 and the bottom edge 25*b* of the projection along with the slot 27 retaining the vertically extending arm 13 can couple the carrier 11 and the elongated member 31 to the mounting body 21. When so coupled to the mounting body 21, the first end of the elongated member 31 can extends past a first side of the door to the door frame and/or wall adjacent the first side of the door frame and a second end of the elongated member can extend past a second side of the door to the side of the door frame and/or wall adjacent the second side of the door when the vertically extending arm 13 is within the slot 27 to engage the wall(s) and/or door frame to prevent the door from being pulled open by a person outside the room.

When coupled to the mounting body 21 that is attached to the door, the carrier 11 can extend horizontally from its rear to its front so that the carrier 11 is level or is substantially level (e.g. within 5°-20° of being level, within 10° of being level, etc.). The elongated member 31 can extend horizontally from its first end positioned adjacent a wall past a first side of the door 2, through the carrier 11, to its second end adjacent a wall past the second side of the door 2 such that the elongated member is horizontal or substantially horizontal as well (e.g. within 5°-20° of being level, within 10° of being level, etc.) and is oriented transverse or perpendicular to the carrier 11 In other configurations, it is contemplated that the carrier can be coupled to the mounting body 21 in other embodiments so that the carrier 11 and elongated member 31 are oriented in different ways.

The finger 48 can be configured so that the carrier 11 cannot be removed from its coupling with the mounting body 21 via projection 25*a* and slot 27 until a user moves the finger 48 to the unlocked position via surface 49 and (while the finger 48 is in the unlocked position), provides an upward force to move the vertically extending arm 13 out of the slot 27. The elongated member 31 may be decoupled from the carrier 11 at the same time the carrier 11 is removed from the slot 27 via the elongated member's attachment to the carrier 11 via connection mechanism 41.

When not in use for bracing a door during a lockdown situation or other emergency type situation, the carrier 11 and elongated member 31 coupled to the carrier 11 can be positioned adjacent the door 2 via a hanger 51 mounted to a wall adjacent the door 2. The hanger 51 can include a body having a plate member 51*a* and a plurality of fingers that extend from the plate member 51*a*. The fingers can include a first finger 51*b* that is spaced apart from a second finger 51*c* to define a gap 51*d*. The gap 51*d* can be sized to permit the elongated member 31 to pass through the gap when the fingers retain the carrier 11 adjacent the plate member 51*a* as can be seen from FIG. 6, for example. The distal ends of the fingers can be structured to help retain the carrier 11. For example, the distal ends of the fingers can be curved so that the middle portion of the fingers extend horizontally or relatively horizontally while the distal ends of the fingers extend upwardly above the middle portions of the fingers. The plate member 51*a* can include holes to receive fasteners so that the plate member 51*a* is mountable to a wall via the fasteners being passed through the holes and into the wall.

When an emergency situation arises or is detected, a user can remove the carrier 11 and elongated member 31 attached to the carrier 11 from the hanger 51 and attach the carrier 11 to the mounting body 21 mounted to the door 2 via the slot 27 and first locking mechanism 47 to brace the door 2. The hanger 51 can keep the carrier 11 and elongated member 31 near the door for quickly and easily facilitating attachment to the door for improving the safety of personnel in the room. When the emergency situation is over, the carrier 11 and elongated member 31 can be decoupled from the mounting body 21 and repositioned on the hanger 51 on the wall so that the hanger 51 holds the carrier 11 and elongated member 31 attached to the carrier 11 until it is needed again.

In some work environments, such as classrooms involving high school or middle school age children, it may be desired to have a mechanism by which the position of the carrier 11 and elongated member 31 can be locked so that a student cannot move the carrier 11 and elongated member 31 off the hanger 51 and to its engaged position on the door 2 via the slot 27 and first locking mechanism 47 without approval or instruction from a teacher. A second locking mechanism 71 can be provided to help avoid such a circumstance arising or some other problematic type situation (e.g. a student improperly uses the guard apparatus to locks a teacher out of a classroom or to hit a teacher or removes the carrier 11 and elongated member 31 from the holder 51 to use it to hit another student, etc.). The second locking mechanism 71 can be configured as a positional locking feature that prevents a person from moving the guard apparatus freely around a room or using the guard apparatus for an unintended and improper purpose (e.g. hitting a student). The second locking mechanism 71 can be include a mounting plate 70 that can be mounted adjacent a door 2 (e.g. to a door frame or a wall adjacent a door frame). A lock connector body 72 can be connected to the mounting plate and include an opening through which an elongated element 77 (e.g. a cable, rubber coated metal braided cable with loops on each end, a chain, a wire, etc.) can extend. In some embodiments, the connector body 72 can be configured as a swivel metal piece with a hole. In other embodiments, the connector body can be configured as a protrusion or projection that has an opening (e.g. a hole, a hook structure, an opening in communication with a closeable slit, etc.).

Figure 9:
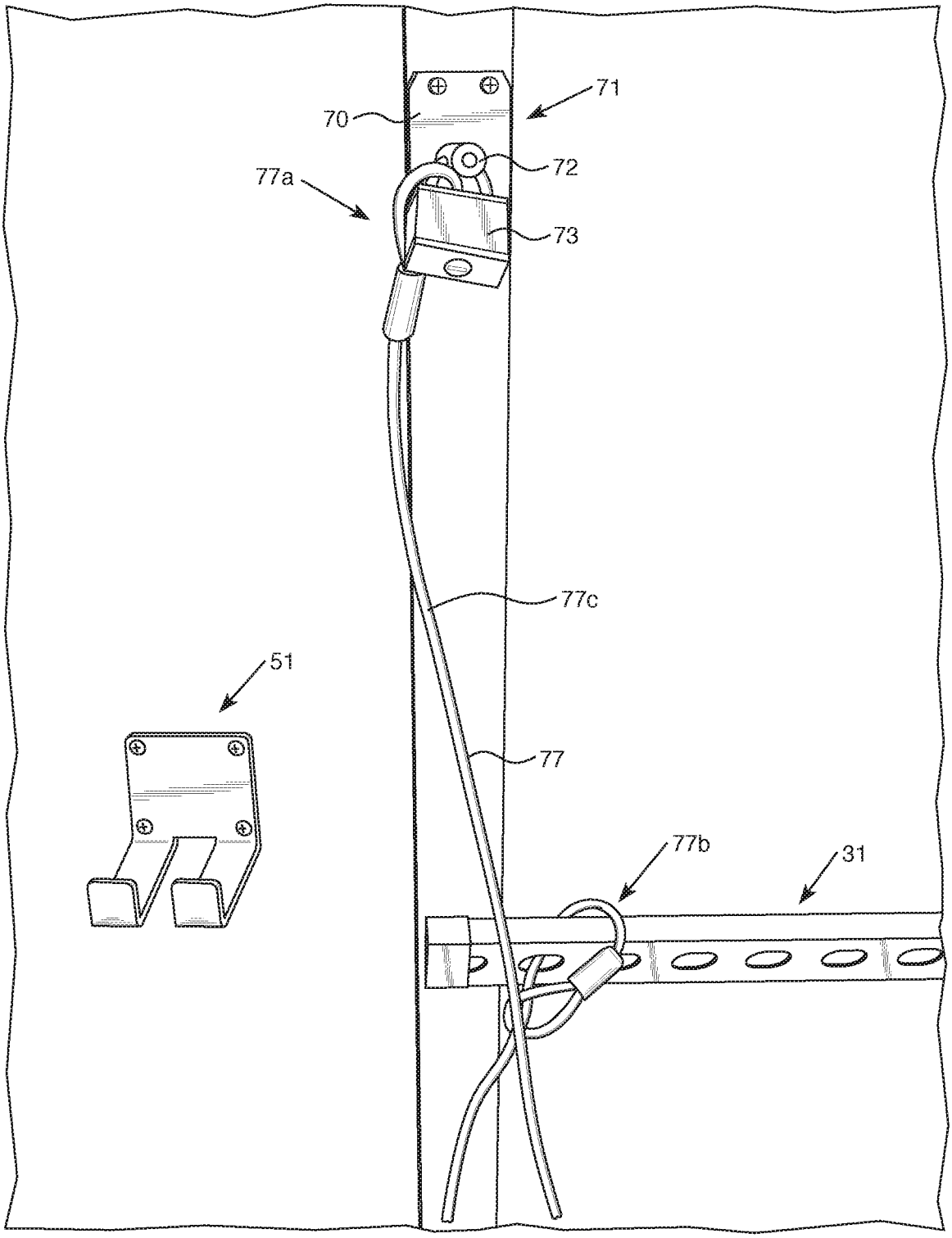
FIG. 9 is a fragmentary perspective view of the first exemplary embodiment of the door guard apparatus positioned to prevent the door from being opened in which a second locking mechanism is used to lock the apparatus in this position.
Figure 10:
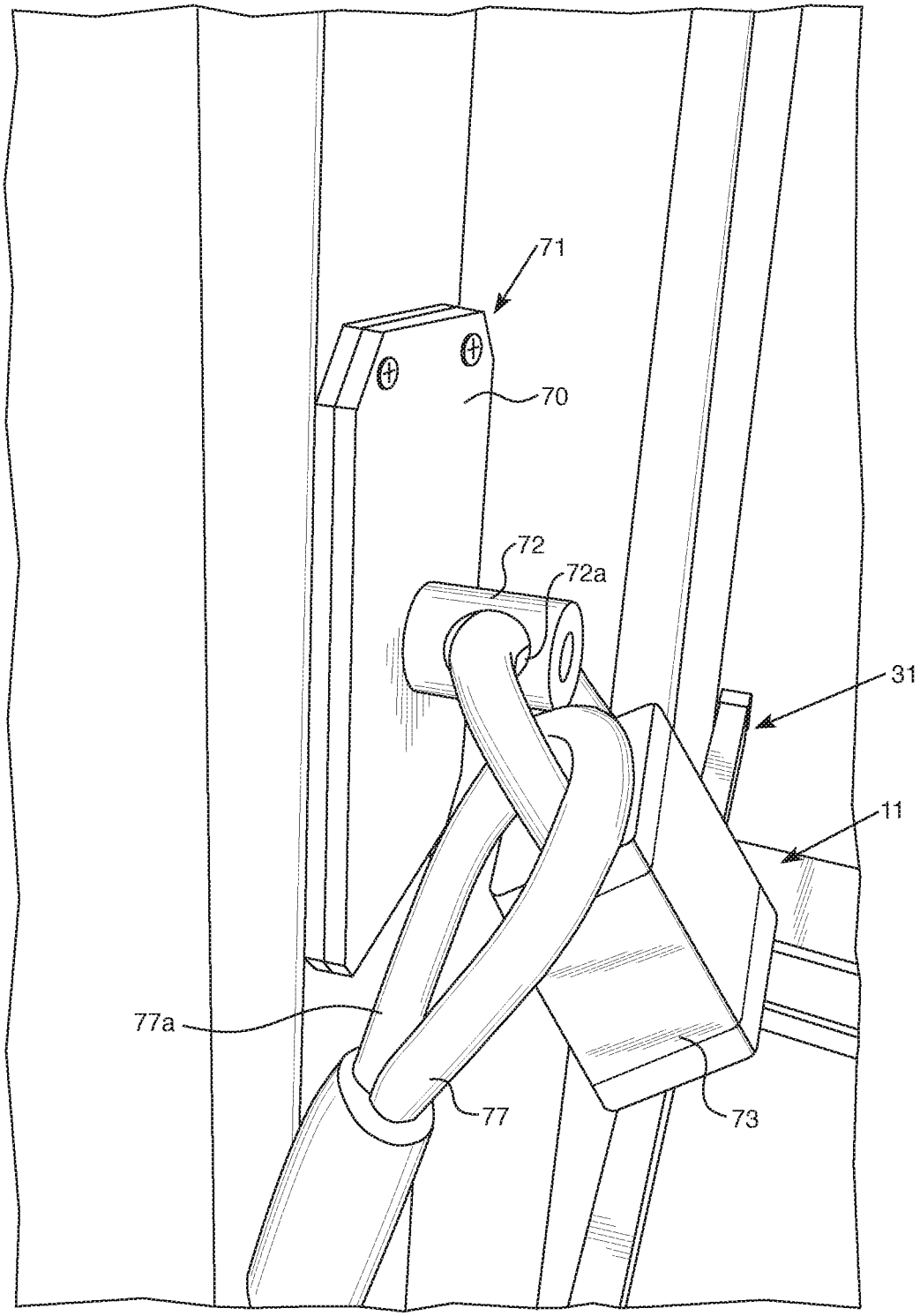
FIG. 10 is an enlarged fragmentary view of the first exemplary embodiment of the door guard apparatus that illustrates a lock that can be used in the second locking mechanism.

The elongated element 77 can be flexible or otherwise configured to be curved, bent, or flexed into different positions and may be configured to extend from the lock connector body 72 to the carrier member 11 or the elongated member 31 for attachment to the carrier member 11 and/or the elongated member 31. For instance, a first end of the elongated element 77*a* can be connected to the connector body 72 and the second end 77*b* of the elongated element can be connected adjacent an end of the elongated member 31 as shown in FIGS. 9 and 10. A middle portion 77*c* of the elongated element that is between its first and second ends 77*a* and 77*b* can be positioned through a hole in the elongated member and inserted through a loop defined in the second end 77*b* of the elongated element 77 for attachment of the elongated element 77 to the elongated member 31. The first end 77*a* of the elongated element 77 can be connected to the lock connector body 72 via a lock that can be positioned through the opening in the connector body 72 as shown, for example, in FIGS. 9 and 10. The lock 73 can be a commercial padlock, a combination lock, a lock that requires use of a key to move the lock from a locked position to an unlocked position, or another type of lock. In some embodiments, the lock 73 can be configured to be adjusted between its locked and unlocked positions via use of radio frequency identification (RFID) technology (e.g. closeness of a fob), a Bluetooth connection between the lock and a teacher's smart phone, or another type of actuation mechanism.

When in the locked position, the lock 73 can connect the elongated element 77 to the connector body 72 so that the elongated member 31 and carrier 11 cannot be moved freely about a room. When so connected to the plate 70 via the connector body 72 and lock 73, the elongated element 77 can function to constrain the possible positions for the carrier 11 and the elongated member 31 to adjacent the door (e.g. either positioned on holder 51 or in an engaged position with first locking mechanism 47 on the door 2) so that it cannot be used for an improper purpose unless the lock 73 is moved to its unlocked position to release the elongated element 77. Such an impediment should limit, if not fully prevent, improper use of the door guard apparatus.

It should be appreciated that other modifications of the method, a door guard, and apparatus for guarding a door may be made to meet different sets of design criteria. For instance, the elongated member 31 can be configured as a rod, a bar, a rail or other type of elongated member. The elongated member can be composed of metal, such as steel or may alternatively be composed of another type of suitable material. The carrier 11 can be composed of metal or another type of suitable material and have any of a number of different shaped bodies. As yet another example, the mounting body 21 size and shape can be any of a number of suitable shapes and sizes to accommodate a particular type of door or a range of different door structures. For instance, the shape and size of the inner and outer plates 23 and 25 can be any of a number of suitable shapes and sizes (e.g. polygonal, elliptical, circular, etc.) and the shape and size of the projection 25*a* can be any type of suitable shape or size. As yet another example, the shape and structure of the finger 48 and/or biasing mechanism 61 can be any of a number of different shapes and structures for accommodating different shape or geometries. Additionally, the mounting body 21 can be mounted to a door in any number of different ways (e.g. use of fasteners, use of double sided tape and fasteners, use of an adhesive, combinations thereof, etc.). In some embodiments, it is contemplated that the biasing mechanism 61 can include a coil spring or other type of spring mechanism instead of a torsion spring or could include some other type of biasing mechanism. Thus, while certain exemplary embodiments of a door guard, door guard assembly, apparatus for guarding a door and methods of making and using the same have been shown and described above, it is to be distinctly understood that the invention is not limited thereto but may be otherwise variously embodied and practiced within the scope of the following claims.

What is claimed is:

1. A door guard apparatus comprising:

an elongated member having a first end and a second end opposite the first end;

a carrier, the carrier having a front and a rear, the front of the carrier having a vertically extending arm, the elongated member passing through a middle portion of the carrier between the front and the rear of the carrier;

the elongated member being connected to the carrier so that the first end of the elongated member extends away from a first side of the carrier and the second end of the elongated member extends away from a second side of the carrier that is opposite the first side of the carrier;

a locking mechanism connected to the carrier, the locking mechanism moveable between a locked position and an unlocked position;

a biasing mechanism connected between the carrier and the locking mechanism to bias the locking mechanism to the locked position; and a mounting body that is attachable to a door, the mounting body comprising an inner door surface plate and an outer plate connected to a first side of the inner door surface plate and a second side of the inner door surface plate such that a slot is defined between the inner door surface plate and the outer plate, the slot configured to receive the vertically extending arm;

wherein:

the outer plate has a projection that extends outwardly away from the slot and away from the inner door surface plate; and the locking mechanism is configured to contact the projection of the outer plate and move from the locked position to the unlocked position and stay in the unlocked position as the locking mechanism moves along the projection until the locking mechanism reaches a bottom edge of the projection while the vertically extending arm is moved into the slot; and the biasing mechanism is configured to move the locking mechanism from the unlocked position to the locked position so that the locking mechanism contacts the bottom edge and latches on to the bottom edge to lock the carrier onto the mounting body when a moveable finger of the locking mechanism is at the bottom edge of the projection and the vertically extending arm is within the slot.

2. The door guard apparatus of claim 1, wherein the vertically extending arm is at a bottommost position in the slot when the moveable finger contacts the bottom edge of the projection to latch on to the bottom edge to lock the carrier onto the mounting body.

3. The door guard apparatus of claim 1, wherein the biasing mechanism comprises at least one spring or at least one torsion spring.

4. The door guard apparatus of claim 1, wherein the elongated member is adjustably connected to the carrier within a central opening in the middle portion of the carrier between the front and the rear of the carrier such that an extent to which the elongated member extends away from the first side of the carrier and an extent to which the elongated member extends away from the second side of the carrier are adjustable at the same time.

5. The door guard apparatus of claim 4, comprising:

a first end cap connected to the first end of the elongated member for contacting a wall or door frame adjacent a first side of the door; and a second end cap connected to the second end of the elongated member for contacting a wall or door frame adjacent a second side of the door.

6. The door guard apparatus of claim 1, comprising:

a hanger that is mountable to a wall adjacent the door, the hanger having a first finger and a second finger spaced apart from the first finger to define a gap, the elongated member being passable through the gap;

the hanger configured to contact the first side of the carrier or the second side of the carrier to hold the carrier such that the elongated member passes through the gap while the carrier is held by the first and second fingers.

7. The door guard apparatus of claim 6, wherein the hanger also comprises a wall mounting body attached to the first and second fingers such that the first and second fingers extend away from the wall mounting body.

8. The door guard apparatus of claim 6, comprising:

a first end cap connected to the first end of the elongated member for contacting a wall or door frame adjacent a first side of the door; and a second end cap connected to the second end of the elongated member for contacting a wall or door frame adjacent a second side of the door; and wherein the elongated member is adjustably connected to the carrier within a central opening of the middle portion of the carrier between the front and the rear of the carrier such that an extent to which the elongated member extends away from the first side of the carrier and an extent to which the elongated member extends away from the second side of the carrier are adjustable.

9. A method of using a door guard apparatus to brace a door of a room comprising:

providing a door guard apparatus comprising:

an elongated member having a first end and a second end opposite the first end, a carrier, the carrier having a front and a rear, the front of the carrier having a vertically extending arm, the elongated member passing through a middle portion of the carrier between the front and the rear of the carrier, the elongated member being connected to the carrier so that the first end of the elongated member extends away from a first side of the carrier and the second end of the elongated member extends away from a second side of the carrier that is opposite the first side of the carrier, a locking mechanism connected to the carrier, the locking mechanism moveable between a locked position and an unlocked position, a biasing mechanism connected between the carrier and the locking mechanism to bias the locking mechanism to the locked position, and a mounting body that is attachable to a door, the mounting body comprising an inner door surface plate and an outer plate connected to a first side of the inner door surface plate and a second side of the inner door surface plate such that a slot is defined between the inner door surface plate and the outer plate, the slot configured to receive the vertically extending arm;

mounting the mounting body to the door;

moving the vertically extending arm into the slot such that the locking mechanism engages the mounting body and moves from the locked position to the unlocked position as the vertically extending arm is passed into the slot and moves from the unlocked position to the locked position when the vertically extending arm is at a bottom position in the slot; and wherein the first end of the elongated member extends past a first side of the door and a second end of the elongated member extends past a second side of the door when the vertically extending arm is within the slot to prevent the door from being pulled open by a person outside the room.

10. The method of claim 9, wherein the moving of the vertically extending arm into the slot such that the locking mechanism engages the mounting body and moves from the locked position to the unlocked position as the vertically extending arm is passed into the slot and moves from the unlocked position to the locked position when the vertically extending arm is at a bottom position in the slot comprises:

a moveable finger of the locking mechanism contacting a projection extending outwardly and downwardly away from the slot and the outer plate such that the finger is moved away from the slot and guided along the projection until the vertically extending arm is at the bottom position in the slot, the moveable finger being at a bottom edge of the projection when the vertically extending arm is at the bottom position in the slot; and the biasing mechanism acting on the moveable finger to cause the moveable finger to engage the bottom edge of the projection to latch on to the bottom edge of the projection to lock the carrier onto the mounting body while the vertically extending arm is at the bottom position in the slot.

11. The method of claim 10 comprising:

moving the moveable finger away from the bottom edge to unlatch the finger from the bottom edge and move the locking mechanism to the unlocked position; and while the moveable finger is moved away from the bottom edge of the projection and the locking mechanism is in the unlocked position, sliding the vertically extending arm out of the slot.

12. The method of claim 11, comprising:

hanging the carrier on a wall via a hanger mounted to the wall.

13. The method of claim 12, wherein the carrier is hung via the hanger such that first and second spaced apart fingers of the hanger contact the first side of the carrier or the second side of the carrier to hold the carrier and the elongated member passes through a gap between the first and second fingers while the carrier is held by the first and second fingers.

14. The method of claim 10, comprising:

adjusting a position of the elongated member within a central opening in the middle portion of the carrier between the front and the rear of the carrier such that an extent to which the elongated member extends away from the first side of the carrier and an extent to which the elongated member extends away from the second side of the carrier are adjusted at the same time.

15. The method of claim 10, wherein the biasing mechanism comprises at least one spring or at least one torsion spring.

16. A door guard comprising:

an elongated member having a first end and a second end opposite the first end;

a carrier, the carrier having a front and a rear, the front of the carrier having a vertically extending arm, the elongated member passing through a middle portion of the carrier between the front and the rear of the carrier;

the elongated member being connected to the carrier so that the first end of the elongated member extends away from a first side of the carrier and the second end of the elongated member extends away from a second side of the carrier that is opposite the first side of the carrier;

a locking mechanism connected to the carrier, the locking mechanism having a moveable finger that is moveable between a locked position and an unlocked position;

at least one spring member connected between the carrier and the locking mechanism to bias the moveable finger of the locking mechanism to the locked position;

a mounting body that is attachable to a door, the mounting body comprising an inner door surface plate and an outer plate connected to a first side of the inner door surface plate and a second side of the inner door surface plate such that a slot is defined between the inner door surface plate and the outer plate, the slot configured to receive the vertically extending arm; and wherein the outer plate has a projection that extends outwardly away from the slot and away from the inner door surface plate;

wherein the moveable finger is configured to contact the projection and move from the locked position to the unlocked position and stay in the unlocked position as the moveable finger moves along the projection until the moveable finger reaches a bottom edge of the projection while the vertically extending arm is moved into the slot; and wherein the moveable finger is biased to contact the bottom edge and latch on to the bottom edge of the projection to lock the carrier onto the mounting body via the at least one spring member when the moveable finger is at the bottom edge of the projection.

17. The door guard of claim 16, wherein the vertically extending arm is at a bottommost position in the slot when the moveable finger contacts the bottom edge of the projection to latch on to the bottom edge to lock the carrier onto the mounting body.

* * * * *